US011486252B2

(12) United States Patent
Sultana et al.

(10) Patent No.: US 11,486,252 B2
(45) Date of Patent: Nov. 1, 2022

(54) ROTOR DISC WITH AXIAL RETENTION OF THE BLADES, ASSEMBLY OF A DISC AND A RING, AND TURBOMACHINE

(71) Applicant: SAFRAN AIRCRAFT ENGINES, Paris (FR)

(72) Inventors: Patrick Jean Laurent Sultana, Moissy-Cramayel (FR); Arnaud Lasantha Genilier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/266,653

(22) PCT Filed: Aug. 26, 2019

(86) PCT No.: PCT/FR2019/051963
§ 371 (c)(1),
(2) Date: Feb. 8, 2021

(87) PCT Pub. No.: WO2020/049238
PCT Pub. Date: Mar. 12, 2020

(65) Prior Publication Data

US 2021/0355830 A1 Nov. 18, 2021

(30) Foreign Application Priority Data

Sep. 4, 2018 (FR) ..... 1857926

(51) Int. Cl.
*F01D 5/08* (2006.01)
*F01D 5/30* (2006.01)

(52) U.S. Cl.
CPC ..... *F01D 5/081* (2013.01); *F01D 5/30* (2013.01); *F05D 2220/323* (2013.01); *F05D 2240/30* (2013.01); *F05D 2260/201* (2013.01)

(58) Field of Classification Search
CPC ..... F01D 5/081; F01D 5/30; F05D 2220/323; F05D 2240/30; F05D 2260/201
See application file for complete search history.

(56) References Cited

U.S. PATENT DOCUMENTS 3,748,060 A * 7/1973 Hugoson ..... F01D 5/3015 416/193 A
4,505,640 A * 3/1985 Hsing ..... F01D 5/187 416/219 R (Continued)

FOREIGN PATENT DOCUMENTS

EP 2372094 A2 10/2011
EP 2518271 A2 10/2012

(Continued)

OTHER PUBLICATIONS

French Search Report in FR Application No. 1901636, dated Sep. 4, 2019, (2 pages).

(Continued)

*Primary Examiner* — Igor Kershteyn
*Assistant Examiner* — Brian Christopher Delrue
(74) *Attorney, Agent, or Firm* — Bookoff McAndrews, PLLC

(57) ABSTRACT

A rotor disc for a turbomachine, the disc extending circumferentially about an axis and including a plurality of cavities configured to receive blade roots, each cavity including a downstream radial wall configured to axially block the blade root in the cavity, each downstream radial wall including a channel of ventilation of the cavity, including an inlet orifice which opens into the cavity and an outlet orifice which opens onto a downstream surface of the disc. An assembly for a turbomachine including such a disc and an upstream retention ring and a turbomachine including such an assembly.

10 Claims, 3 Drawing Sheets

(56) References Cited

U.S. PATENT DOCUMENTS

| | | | | |
|---|---|---|---|---|
| 4,904,160 | A | 2/1990 | Partington | |
| 5,402,636 | A * | 4/1995 | Mize | F01D 5/081 415/115 |
| 5,957,660 | A * | 9/1999 | Evans | F01D 5/081 416/97 R |
| 6,290,464 | B1 * | 9/2001 | Negulescu | F01D 1/32 416/97 R |
| 8,807,942 | B2 * | 8/2014 | Tibbott | F01D 5/085 416/96 R |
| 9,353,643 | B2 | 5/2016 | Major | |
| 9,435,213 | B2 | 9/2016 | Wunderle et al. | |
| 10,443,402 | B2 | 10/2019 | Burford et al. | |
| 2005/0201857 | A1 * | 9/2005 | Ferra | F01D 5/082 415/115 |
| 2005/0232751 | A1 * | 10/2005 | Townes | F01D 5/088 415/115 |
| 2006/0120855 | A1 | 6/2006 | Djeridane et al. | |
| 2013/0039760 | A1 * | 2/2013 | Burt | F01D 5/3015 416/1 |
| 2015/0125301 | A1 | 5/2015 | Headland | |
| 2016/0186593 | A1 | 6/2016 | Healy | |
| 2016/0222810 | A1 | 8/2016 | Leduc et al. | |
| 2016/0230579 | A1 * | 8/2016 | Schwartz | F01D 5/326 |
| 2016/0273370 | A1 * | 9/2016 | Belshaw | F01D 25/12 |
| 2017/0022836 | A1 * | 1/2017 | Negulescu | F01D 5/187 |
| 2017/0067356 | A1 | 3/2017 | Vogel et al. | |
| 2021/0277790 | A1 * | 9/2021 | Seisdedos Santos | F01D 11/006 |

FOREIGN PATENT DOCUMENTS

| | | | |
|---|---|---|---|
| EP | 2557272 | A1 | 2/2013 |
| GB | 631152 | A | 10/1949 |

OTHER PUBLICATIONS

French Search Report in corresponding Application No. FR1857926, dated Jun. 24, 2019, (2 pages).

International Search Report in corresponding Application No. PCT/FR2019/051963, dated Dec. 13, 2019, (2 pages).

* cited by examiner

ROTOR DISC WITH AXIAL RETENTION OF THE BLADES, ASSEMBLY OF A DISC AND A RING, AND TURBOMACHINE

CROSS-REFERENCE TO RELATED APPLICATION(S)

This application is the U.S. national phase entry under 35 U.S.C. § 371 of International Application No. PCT/FR2019/051963, filed on Aug. 26, 2019, which claims priority to French Patent Application No. 1857926, filed on Sep. 4, 2018.

TECHNOLOGICAL FIELD

The present disclosure concerns a rotor disc for a turbomachine, for example a low-pressure turbine rotor disc of a turbojet engine.

TECHNOLOGICAL BACKGROUND

In a known manner, a turbomachine includes an aerodynamic flow path in which movable impellers (rotor portion) which recover the energy from the gases derived from the combustion chamber and distributors (stator portion) which straighten the flow of gases in the aerodynamic flow path follow each other. The movable impellers generally include a disc movable in rotation about an axis of rotation, the disc being provided with blades. The blades may be manufactured separately and assembled on the disc by interlocking of the blade roots in cavities of the disc. The shape of the cavities is generally obtained by broaching of each cavity. The cavities are therefore through cavities. Therefore, the blades are generally axially blocked on their upstream and downstream faces by retention rings.

In particular in a low-pressure turbine of a turbomachine, the rings of axial retention of the blades located generally upstream and downstream of the blade roots undergo stresses that may cause gas leaks, particularly the downstream retention ring which undergoes more stresses than the upstream retention ring, because it is subjected to mechanical and thermal stresses which are greater, in particular because of the aerodynamic axial force which tends to push the blade downstream. In addition, the blade is also axially blocked by a movable ring bearing against the downstream retention ring. This movable ring rotates about the axis of rotation with the rotor and generally bears against two successive stages of the rotor of the turbine, the movable ring being axially clamped between the two stages in order to ensure the axial blocking of the blades in the disc. Also, the service life of the retention rings, particularly of the downstream retention ring, and of the movable ring is dependent on the mechanical and thermal stresses that these parts undergo in operation. Replacing these parts may turn out to be a very complex, costly and time consuming operation.

It will be noted that the terms "upstream" and "downstream" are defined in relation to the direction of circulation of air in the turbomachine.

Presentation

The present disclosure aims at overcoming at least partly these drawbacks.

To this end, the present disclosure concerns a rotor disc for a turbomachine, the disc extending circumferentially about an axis and including a plurality of cavities configured to receive blade roots, each cavity including a downstream radial wall configured to axially block the blade root in the cavity, each downstream radial wall including a channel of ventilation of the cavity, including an inlet orifice which opens into the cavity and an outlet orifice which opens onto a downstream surface of the disc.

The axis of rotation of the disc defines an axial direction which corresponds to the direction of the axis of symmetry (or quasi-symmetry) of the disc. The radial direction is a direction perpendicular to the axis about which the disc extends circumferentially and intersecting this axis. Likewise, an axial plane is a plane containing the axis of the disc and a radial plane is a plane perpendicular to this axis.

Unless otherwise specified, the adjectives "internal/inner" and "external/outer" are used with reference to a radial direction so that the internal portion of an element is, along a radial direction, closer to the axis of rotation of the disc as the external portion of the same element.

Each cavity including a downstream radial wall, it is possible to axially block the blade in the cavity and dispense with the use of a downstream retention ring. It is understood that the downstream radial wall may be formed integrally with the disc.

In addition, due to the absence of the downstream retention ring, it is also possible to eliminate the hook for holding the ring of downstream retention of the blade. Thus, the blade, in particular the blade root and the inner platform, may have a simpler geometric shape. The manufacture of the blade is therefore less complex.

In addition, due to the absence of the downstream retention ring, it is also possible to dispense with the upstream portion of the movable ring, that is to say the portion of the movable ring upstream of the sealing wipers. Indeed, the movable disc may no longer be in compression between two rotor stages to maintain the downstream retention ring.

Assembling the stages of the rotor, and particularly the blades on the discs of the different stages of the rotor, is less complex and involves using a reduced number of elements. This results in a reduction in the rotor weight.

Thanks to the presence of a ventilation channel whose inlet orifice is present in each downstream radial wall, it is possible to ventilate each cavity and thus ensure efficient and uniform cooling of all the cavities of the disc.

In addition, the cooling of the disc is monitored by the dimension of the outlet orifice of the ventilation channel.

With this arrangement, it is possible to reduce the leakage of the air stream into the cooling stream. The flow rate of the cooling stream may therefore be better monitored and therefore reduced, which allows increasing the purge flow rate upstream of the first movable impeller at a constant total flow rate (purge stream and cooling stream). Thus, this arrangement allows improving the efficiency of the turbomachine.

The turbomachine may for example be a turbojet engine.

The rotor may for example be a turbine rotor.

The turbine may for example be a low-pressure turbine.

In some embodiments, the outlet orifice opens onto a downstream surface of the downstream radial wall.

In some embodiments, each downstream radial wall includes an outlet orifice.

In some embodiments, the ventilation channel links at least two inlet orifices and one outlet orifice.

The ventilation channel is present in the downstream radial wall and also in portions of the disc delimiting the cavities, for example teeth of the disc which delimit the cavity, along the circumferential direction.

In some embodiments, the ventilation channel links all of the inlet orifices.

The ventilation channel may be a circumferential channel linking all the inlet orifices to each other.

The circumferential direction is a direction along a circle which lies in a radial plane and whose center is the axis of rotation.

It is understood that the ventilation channel may have a shape other than a circumferential shape.

In some embodiments, the inlet orifices have an inlet diameter and the outlet orifices have an outlet diameter, the number of inlet orifices being greater than or equal to the number of outlet orifices and the inlet diameter being greater than or equal to the outlet diameter.

In some embodiments, the inlet orifices have a frustoconical shape that flares from downstream to upstream.

The flaring of the frustoconical shape allows limiting the head loss in the ventilation channel.

In some embodiments, the inlet orifices have an inlet diameter and the outlet orifices have an outlet diameter, the number of inlet orifices being greater than or equal to the number of outlet orifices and the inlet diameter being smaller than or equal to the outlet diameter.

When the number of inlet orifices is greater than the number of outlet orifices, the manufacture of the disc is facilitated because the number of outlet orifices is limited.

Furthermore, when the outlet diameter is greater than the inlet diameter, the discharge of dust that may be present in the air stream is facilitated.

In some embodiments, at least one among the inlet orifices is axially aligned with at least one among the outlet orifices.

The orifices being of generally circular shape, it is understood that the center of the circle forming the inlet orifice and the center of the circle forming the outlet orifice are aligned along a direction parallel to the axis of rotation when a line segment linking the center of the inlet orifice to the center of the outlet orifice is parallel to the axis of rotation.

In some embodiments, at least one among the inlet orifices is circumferentially and/or radially offset relative to at least one among the outlet orifices.

Thus, the center of the circle forming the inlet orifice and the center of the circle forming the outlet orifice may be offset relative to each other along a circumferential and/or radial direction.

In some embodiments, the downstream radial wall has a thickness greater than or equal to 0.5 mm (millimeter) and less than or equal to 10 mm.

The thickness of the walls allows limiting the mass of the disc.

In some embodiments, the inlet orifices have a diameter greater than or equal to 0.5 mm and less than or equal to 10 mm.

The inlet orifice with a diameter greater than or equal to 0.5 mm allows limiting the risk of clogging of the ventilation duct.

In some embodiments, the outlet orifices have a diameter greater than or equal to 0.5 mm and less than or equal to 10 mm.

The outlet orifice with a diameter greater than or equal to 0.5 mm allows limiting the risk of clogging of the ventilation duct.

The present disclosure also concerns an assembly for a turbomachine including a disc as defined above and an upstream retention ring.

The assembly may include blades assembled on the disc.

The present disclosure also concerns a turbomachine including an assembly as defined above.

It is understood that the turbomachine may include one or more stages including an assembly as defined above. For example, the turbomachine may be a turbojet engine. For example, the assembly as defined above may be disposed in the low-pressure turbine of the turbojet engine.

BRIEF DESCRIPTION OF THE DRAWINGS

Other characteristics and advantages of the object of the present disclosure will emerge from the following description of embodiments, given by way of non-limiting examples, with reference to the appended figures, in which.

In all the figures, the elements in common are identified by identical numeric references.

DETAILED DESCRIPTION

Figure 1:
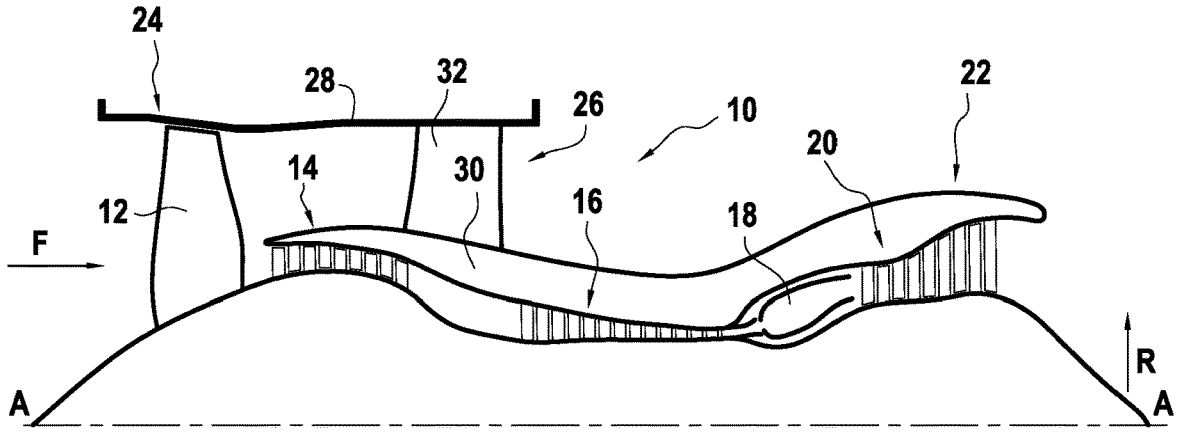
FIG. 1 is a schematic longitudinal sectional view of a turbojet engine.

FIG. 1 represents in cross-section along a vertical plane passing through its main axis A, a turbofan engine 10 which is an example of a turbomachine. The turbofan engine 10 includes, from upstream to downstream along the circulation of the air stream F, a fan 12, a low-pressure compressor 14, a high-pressure compressor 16, a combustion chamber 18, a high-pressure turbine 20 and a low-pressure turbine 22.

The terms "upstream" and "downstream" are defined in relation to the direction of circulation of the air in the turbomachine, in this case, according to the circulation of the air stream F in the turbojet engine 10.

The turbojet engine 10 includes a fan casing 24 extended rearward, that is to say downstream, by an intermediate casing 26, including an outer shroud 28 as well as a parallel inner shroud 30 disposed, along a radial direction R, internally relative to the outer shroud 28. The radial direction R is perpendicular to the main axis A.

The terms "outer" and "inner" are defined in relation to the radial direction R so that the inner portion of an element is, along the radial direction, closer to the main axis A than the outer portion of the same element.

The intermediate casing 26 further includes structural arms 32 distributed circumferentially and extending radially between the inner shroud 30 up to the outer shroud 28. For example, the structural arms 32 are bolted to the outer shroud 28 and on the inner shroud 30. The structural arms 32 allow stiffening the structure of the intermediate casing 26.

The main axis A is the axis of rotation of the turbojet engine 10 and of the low-pressure turbine 22. This main axis A is therefore parallel to the axial direction.

The low-pressure turbine 22 comprises a plurality of blade impellers which form the rotor of the low-pressure turbine 22.

Figure 2:
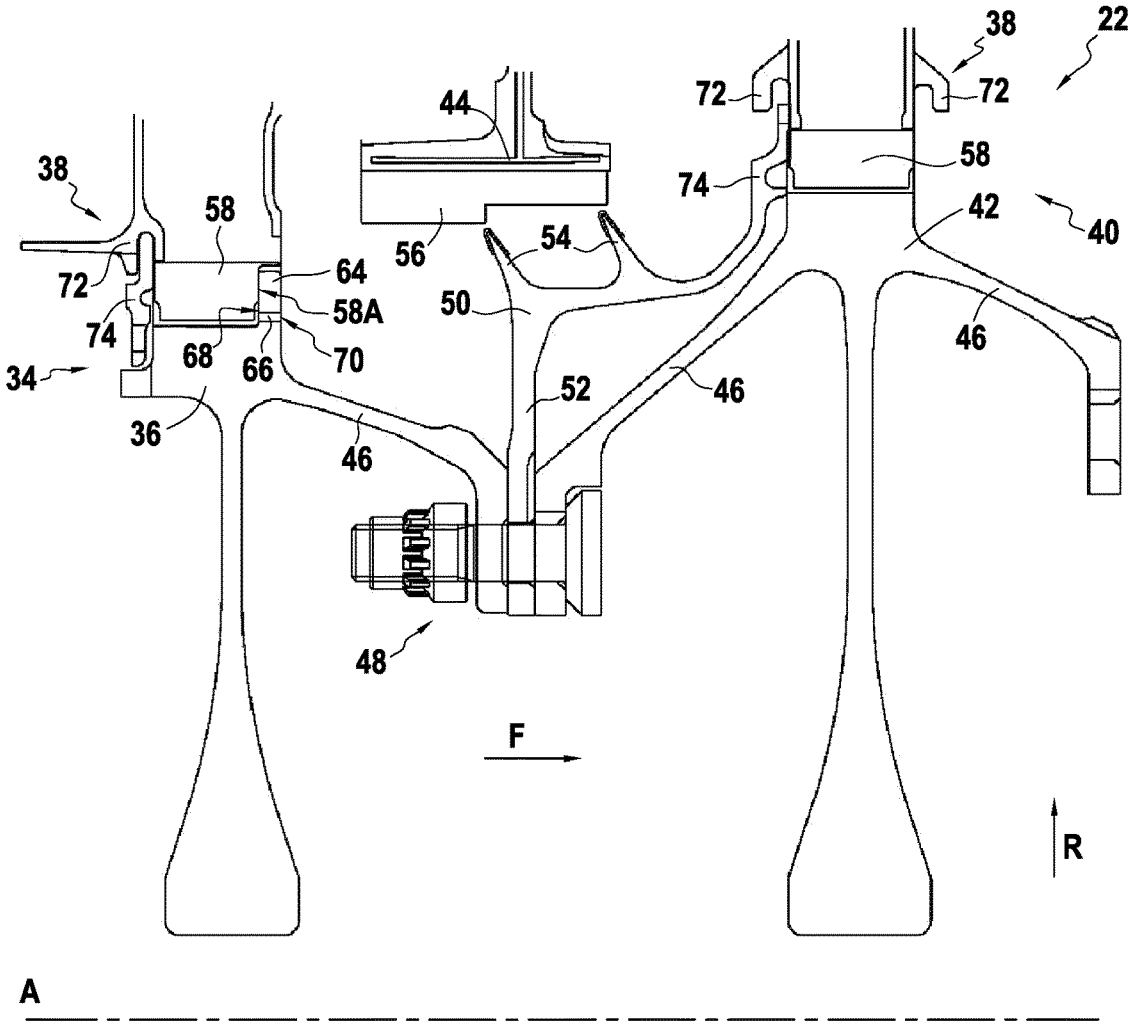
FIG. 2 is an enlarged view of a portion of FIG. 1.

FIG. 2 represents a first and a second stage of the low-pressure turbine 22. The first stage includes a first blade impeller 34 formed of a first disc 36 on the periphery of which blades 38 are assembled. Likewise, the second stage includes a second blade impeller 40 formed of a second disc 42 on the periphery of which blades 38 are assembled. The first and second blade impellers 34, 40 are separated from each other by a distributor 44.

The first and second discs 36, 42 of the rotor each include at least a linking shroud 46.

In the embodiment of FIG. 2, the first disc 36 includes a linking shroud 46, in this case a downstream linking shroud 46 and the second disc 42 includes two linking shrouds 46, an upstream linking shroud 46 and a downstream linking shroud 46. The first and second discs 36, 42 are assembled with each other by means of a plurality of bolts 48 disposed along a circumferential direction C in orifices carried by the downstream linking shroud 46 of the first disc 36 and by the upstream linking shroud 46 of the second disc 42. The bolts 48 also allow assembling a movable ring 50 to the first blade impeller 34 and to the second blade impeller 40.

In FIG. 2, the movable ring 50 includes an assembly web 52 extending along the radial direction R.

The movable ring 50 carries sealing wipers 54 which sealingly cooperate with a ring of abradable material 56 carried by the distributor 44.

As represented in FIG. 2, the blade 38 is assembled on the first disc 36 by insertion of a blade root 58 in a cavity 60 for receiving a blade root.

Figure 3:
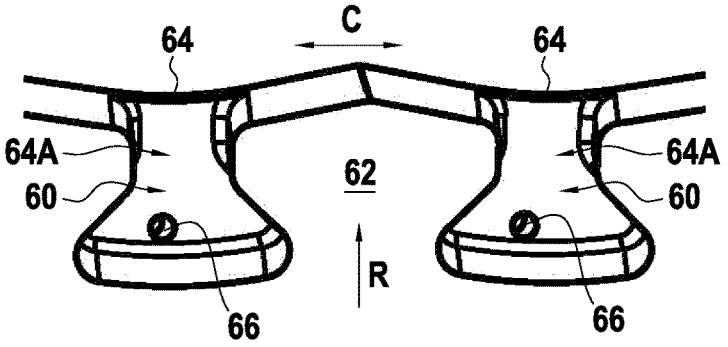
FIG. 3 is a partial perspective view of a turbine disc according to a first embodiment.

As can be seen in FIG. 3, the cavity 60 is delimited along the circumferential direction C by teeth 62 forming portions of the first disc 36 delimiting the cavities 60 along the circumferential direction C. Each cavity 60 includes a downstream radial wall 64. The downstream radial wall 64 is formed integrally with the teeth 62 of the disc 36 and therefore the disc 36 and allows axially blocking the blade root 58 in the cavity 60. Particularly, the axial blocking is achieved by abutting a downstream face 58A of the blade root 58 against an upstream face 64A of the downstream radial wall 64.

Figure 4:
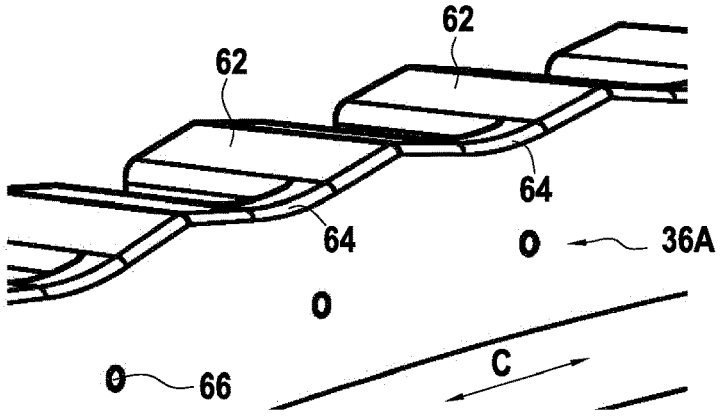
FIG. 4 is a partial perspective view of the disc of FIG. 3.

In the embodiment of FIGS. 2 to 4, each downstream radial wall 64 including a channel of ventilation 66 of the cavity. The channel of ventilation 66 of the cavity 60 includes an inlet orifice 68 and an outlet orifice 70. The ventilation channel 66 opens, through the inlet orifice 68, onto the upstream face 64A of the downstream radial wall 64 and, through the outlet orifice 70, on a downstream face 34A of the disc 34. In the embodiment of FIGS. 2 to 4, the outlet orifice 70 opens onto the downstream face of the radial wall 64, that is to say each downstream radial wall 64 includes an inlet orifice 68 and an outlet orifice 70.

In one embodiment, not represented, the outlet orifice 70 could open onto a portion of the downstream face 34A of the disc 34 which is not the downstream face of the downstream radial wall 64.

In the embodiment of FIGS. 2 to 4, the inlet orifice 68 of each ventilation channel 66 is aligned with the outlet orifice 70 along a direction parallel to the main axis A, that is to say a direction parallel to the axis of rotation of the first disc 36. In addition, the inlet orifice 68 and the outlet orifice 70 are circular in shape, the inlet orifice 68 has an inlet diameter D68 and the outlet orifice 70 has an outlet diameter D70, the inlet diameter D68 of the inlet orifice 68 being equal to the outlet diameter D70 of the outlet orifice 70. The ventilation channel 66 therefore has the shape of a right cylinder with a circular base whose axis is parallel to the main axis A of the turbojet engine 10.

The blades 38 of the first blade impeller 34 include a hook for holding 72 an upstream retention ring 74 for the axial blocking of the blades 38 in the cavities 60.

In the embodiment of FIG. 2, only the first disc 36 includes cavities each including a downstream radial wall. It will be noted that the blade 38 of the second blade impeller 40 includes hooks for holding 72 an upstream and downstream retention ring. It is understood that the second disc 42 could also include cavities each including a downstream radial wall to allow the axial locking of the blade roots. The same applies to the other stages of the low-pressure turbine 22. The blades 38 of these discs could then only include a single groove 72 for receiving an upstream retention ring. It will be noted that in the embodiment of FIG. 2, the movable ring 50 includes a portion acting as an upstream retention ring 74 for the blades 38 of the second blade impeller 40.

For example, the first disc 36 may be produced by additive manufacture, in particular by a powder bed-based additive manufacturing method.

In the following, the elements common to the different embodiments are identified by the same numeric references.

Figure 5:
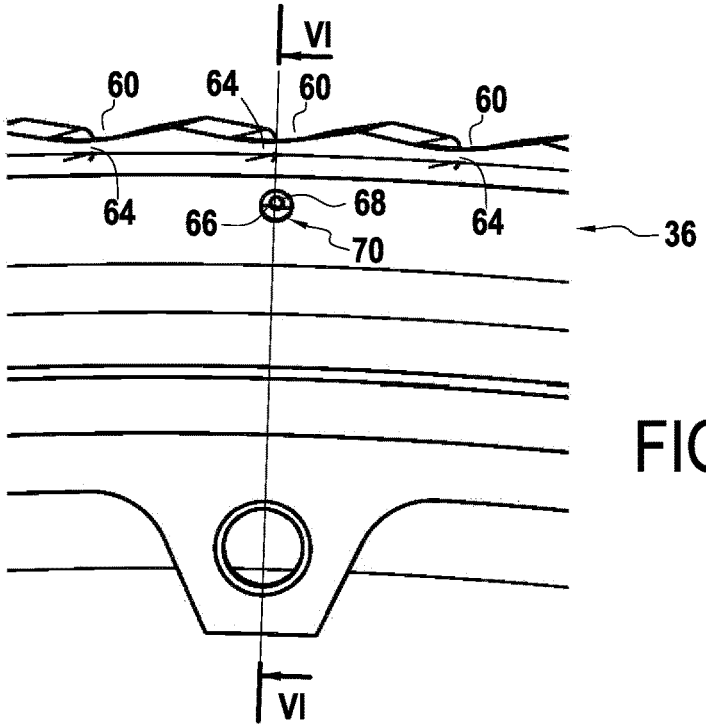
FIG. 5 is a partial perspective view of a turbine disc according to a second embodiment.
Figure 6:
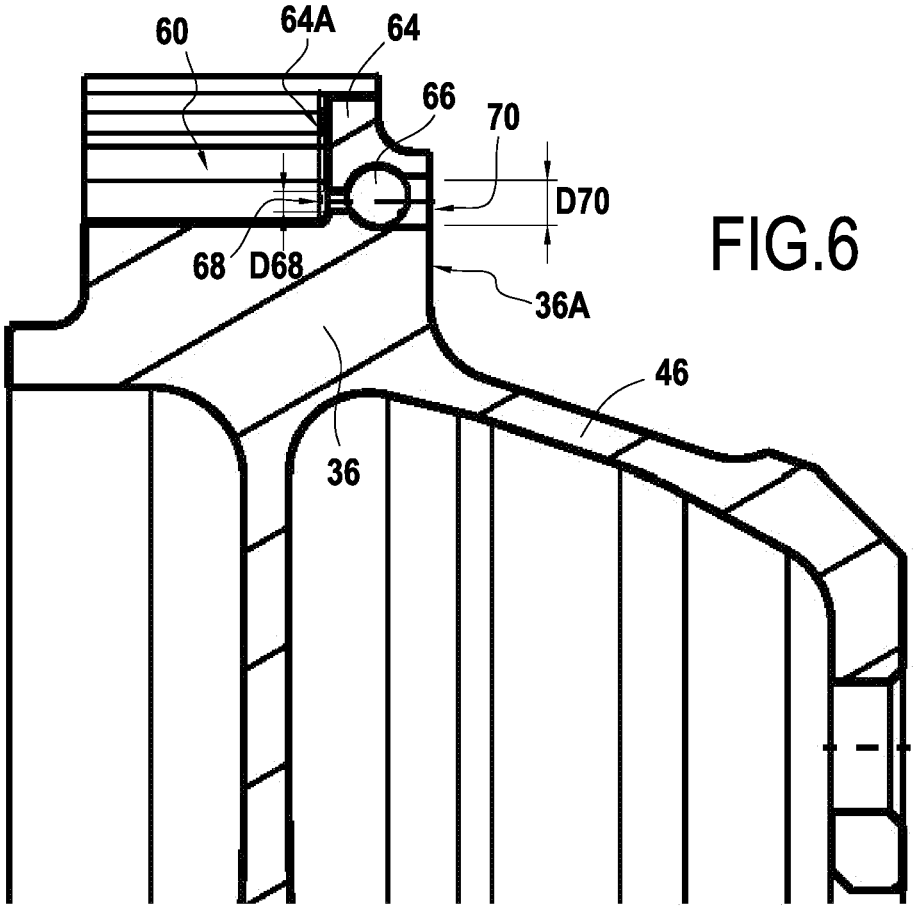
FIG. 6 is a sectional view along the plane VI-VI of FIG. 5.
Figure 7:
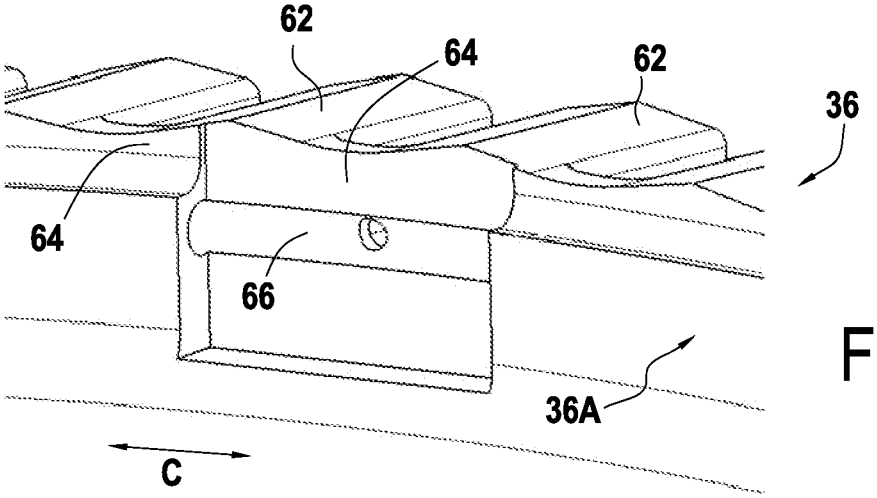
FIG. 7 is a view similar to the view of FIG. 5 with a partial section showing a ventilation channel.

FIGS. 5 to 7 represent a second embodiment. In the embodiment of FIGS. 5 to 7, the ventilation channel 66 of the first disc 36 extends along the circumferential direction C and goes around the first disc 36.

In the embodiment of FIGS. 5 to 7, the ventilation channel 66 links all the inlet orifices 68 together and links at least two inlet orifices 68 to an outlet orifice 70.

For example, in the embodiment of FIGS. 5 to 7, each downstream radial wall 64 does not include an outlet orifice 70, each downstream radial wall 64 including an inlet orifice 68, that is to say an inlet orifice 68 opens onto the upstream face 64A of each downstream radial wall 64. For example, the downstream radial wall 64 of a cavity 60 out of two includes an outlet orifice 70. This example is not limiting. Thus, the downstream radial wall 64 of a cavity 60 out of three, or even more, may include an outlet orifice 70.

In the embodiment of FIGS. 5 to 7, in a first cavity 60 whose downstream radial wall 64 includes an inlet orifice 68 and an outlet orifice 70, the inlet orifice 68 is aligned with the outlet orifice of the ventilation channel 66 of the first cavity 60. In a second cavity 60, adjacent to the first cavity 60, the downstream radial wall 64 includes an inlet orifice 68 communicating with the outlet orifice 70 of the first cavity 60 thanks to the ventilation channel 66 and the inlet orifice 68 of the second cavity 60 is not aligned with the outlet orifice 70, the inlet orifice 68 is offset along the circumferential direction C relative to the outlet orifice 70 of the ventilation channel 66 of the second cavity 60. It is understood that the ventilation channel 66 of the second cavity 60 links the inlet orifice 68 of the downstream radial wall 64 of the second cavity 60 to the outlet orifice 70 of the downstream radial wall 64 of the first cavity 60.

In the embodiment of FIGS. 5 to 7, the inlet diameter D68 of the inlet orifices 68 is smaller than the outlet diameter D70 of the outlet orifices 70.

Although the present disclosure has been described with reference to a specific exemplary embodiment, it is obvious that various modifications and changes may be made to these examples without departing from the general scope of the invention as defined by the claims. For example, the inlet orifice might not be aligned along a direction parallel to the main axis A with the outlet orifice.

Furthermore, individual characteristics of the different embodiments mentioned may be combined in additional embodiments. Consequently, the description and the drawings should be considered in an illustrative rather than a restrictive sense.

The invention claimed is:

1. A rotor disc for a turbomachine, the rotor disc extending circumferentially about an axis and comprising:

a plurality of cavities configured to receive blade roots, each cavity comprising a downstream radial wall configured to axially block the blade root in the cavity, each downstream radial wall comprising a ventilation channel of the cavity; and at least one inlet orifice which opens into at least one cavity of the plurality of cavities and at least one outlet orifice which opens out from a downstream surface of the rotor disc, wherein the at least one inlet orifice includes a plurality of inlet orifices; and the ventilation channel links at least two of the plurality of inlet orifices and the at least one outlet orifice.

2. The rotor disc according to claim 1, wherein the at least one outlet orifice opens out from a downstream surface of the downstream radial wall of one or more of cavity of the plurality of cavities.

3. A rotor disc for a turbomachine, the rotor disc extending circumferentially about an axis and comprising:

a plurality of cavities configured to receive blade roots, each cavity comprising a downstream radial wall configured to axially block the blade root in the cavity, each downstream radial wall comprising a ventilation channel of the cavity; and at least one inlet orifice which opens into at least one cavity of the plurality of cavities and at least one outlet orifice which opens out from a downstream surface of the rotor disc, wherein:

the at least one inlet orifice includes a plurality of inlet orifices; and the ventilation channel links all of the plurality of inlet orifices.

4. The rotor disc according to claim 1, wherein:

the at least one inlet orifice includes a plurality of inlet orifices;

each inlet orifice of the plurality of inlet orifices has an inlet diameter;

the at least one outlet orifice includes a plurality of outlet orifices;

each outlet orifice of the plurality of outlet orifices has an outlet diameter;

the number of inlet orifices is greater than or equal to the number of outlet orifices; and the inlet diameter is smaller than or equal to the outlet diameter.

5. The rotor disc according to claim 1, wherein:

the at least one inlet orifice includes a plurality of inlet orifices;

the at least one outlet orifice includes a plurality of outlet orifices;

at least one of the plurality of inlet orifices is axially aligned with at least one of the plurality of outlet orifices.

6. The rotor disc according to claim 1, wherein:

the at least one inlet orifice includes a plurality of inlet orifices;

the at least one outlet orifice includes a plurality of outlet orifices; and at least one of the plurality of inlet orifices is one or more of circumferentially or radially offset relative to at least one of the plurality of outlet orifices.

7. The rotor disc according to claim 1, wherein the downstream radial wall has a thickness greater than or equal to 0.5 mm and less than or equal to 10 mm.

8. The rotor disc according to claim 1, wherein one or more of the at least one inlet orifice or the at least one outlet orifice has a diameter greater than or equal to 0.5 mm and less than or equal to 10 mm.

9. An assembly for a turbomachine comprising a rotor disc according to claim 1 and an upstream retention ring.

10. A turbomachine comprising:

at least one rotor stage that includes an assembly according to claim 9.

* * * * *